US006493997B2

(12) United States Patent
Cohen

(10) Patent No.: US 6,493,997 B2
(45) Date of Patent: Dec. 17, 2002

(54) PORTABLE GARAGE WITH BALLAST-CONTAINING WALLS

(75) Inventor: Melvin Cohen, Clifton, NJ (US)

(73) Assignee: Handi-Hut Shelters, L.L.C., Clifton, NJ (US)

( * ) Notice: Subject to any disclaimer, the term of this patent is extended or adjusted under 35 U.S.C. 154(b) by 34 days.

(21) Appl. No.: 09/745,128

(22) Filed: Dec. 21, 2000

(65) Prior Publication Data

US 2002/0144468 A1 Oct. 10, 2002

(51) Int. Cl.[7] ..... E04H 6/00
(52) U.S. Cl. ..... 52/79.9; 248/910; 135/116
(58) Field of Search ..... 52/79.9, 71, 79.5, 52/36.4, 36.5, 86, 2.23, 2.22; 404/6, 10; 135/116

(56) References Cited

U.S. PATENT DOCUMENTS

| | | | | |
|---|---|---|---|---|
| 1,540,988 | A | 6/1925 | Hensel | |
| 2,928,405 | A | 3/1960 | Lawson | |
| 3,492,767 | A | 2/1970 | Pincus | |
| 4,627,205 | A | 12/1986 | Hitchins | |
| 4,856,228 | A | 8/1989 | Robinson | |
| 5,208,585 | A | 5/1993 | Sprague | |
| 5,295,335 | A | 3/1994 | Collier | |
| 5,414,966 | A | 5/1995 | Montoya | |
| 5,551,578 | A | 9/1996 | McCue et al. | 211/17 |
| 5,815,991 | A | 10/1998 | de Ridder | |
| 5,846,020 | A | 12/1998 | McKeown | |
| 6,298,997 | B1 | 10/2001 | Jarrett et al. | 211/17 |

*Primary Examiner*—Lanna Mai
*Assistant Examiner*—Jerry A. Anderson
(74) *Attorney, Agent, or Firm*—Siegmar Silber, Esq.

(57) ABSTRACT

The disclosure describes a portable garage with a ballast-containing base. The garage is assembled at a site without physical attachment thereto and disassembled for erection at another site. Each elongated base segment extending along the sidewall of the garage has a cavity therein for receiving ballast, which, after erection of the garage, is filled with water, sand or gravel. The weight thereof stabilizes the structure. The bases have extensions which interlock and overlie connector portions. Apertures through the connectors house support members and, upon the sidewall being assembled, these columns are vertically disposed. Between support members a prefabricated roof is attached. The ballast-container is a lightweight, molded plastic construct of high-impact, UV resistant material. The base is equipped with suitable inlet and outlet ports for the addition and removal of ballast.

10 Claims, 6 Drawing Sheets

PORTABLE GARAGE WITH BALLAST-CONTAINING WALLS

BACKGROUND OF THE INVENTION

1. Field of the Invention

This invention relates to a garage, and, more particularly, to a garage which is readily erected and disassembled and is secured in place by adding ballast, such as water, to cavities at the base of the walls. The structure is designed to be disposed atop a flat surface such as a blacktop driveway or a concrete slab without physical attachment thereto.

2. Description of the Prior Art

In the past, the automobile has been cared for in innumerable creative ways. The romance with the automobile, particularly in the United States, has led to devices and structures ranging from cloth covers tailored, like raincoats to fit the make and model of the automobile, to detached three- and four-car garages, some replete with living quarters for the chauffeur and his spouse. All of these have sought to protect the automobile from the elements—both natural and corrosive—including, of course, sun, precipitation and acid rain, salt air, and industrial pollution.

Also, garage construction has usually been dominated by conventional construction methods involving footings or foundations with little attention being paid to the ability of being "knocked down" and re-erected at another site.

As will be seen in the prior art discussion which follows, "Jersey-type" barriers have not been widely adapted to structures. In the solid form, the Jersey barrier has been used for a multilevel roadway structure. In 1987 the ballast-containing form of the Jersey barrier was introduced and the adaptive use thereof includes a highway sign support device.

In preparing for this application, several United States patents became known to the inventor hereof. The familiarity resulted from a review of several subclasses of Classes 52, 135, and 404, which review produced the following patents:

| Patent | Inventor | O.C. | Issue Date |
|---|---|---|---|
| 5,846,020 | McKeown | 404/1 | 12/08/1998 |
| 5,815,991 | de Ridder | 52/88 | 10/06/1998 |
| 5,414,966 | Montoya | 52/66 | 05/16/1995 |
| 5,295,335 | Collier | 52/86 | 03/22/1994 |
| 5,208,585 | Sprague | 340/908.1 | 05/04/1993 |
| 4,856,228 | Robinson | 47/29 | 08/15/1989 |
| 4,627,205 | Hitchins | 52/294 | 12/09/1986 |
| 3,492,767 | Pincus | 52/79 | 02/03/1970 |
| 2,928,405 | Lawson | 135/5 | 03/15/1960 |
| 1,540,988 | Hensel | 49/5 | 06/09/1925 |

McKeown—U.S. Pat. No. 5,846,020

The patent discloses a prefabricated reinforced concrete multi-level roadway structure. The structure is erected so as to cover an existing lane on a roadway and is assembled from modules that are cast, transported, and moved, as needed. The cover of the lower roadway forms the roadway of the upper lane with the bottom section thereof consisting of two "Jersey-type" barriers.

Robinson—U.S. Pat. No. 4,856,228 and de Ridder—U.S. Pat. No. 5,815,991

These patents disclose the use of water ballasted, inflatable tunnel systems for pressurized tunnel-type greenhouses. The tunnels are generally semicircular in cross section.

Sprague—U.S. Pat. No. 5,208,585

This patent discloses a portable "Jersey-type" highway barrier constructed of light weight material has an interior cavity which can be filled with a fluid ballast. The barrier includes vertical slots which support highway sign.

Pincus—U.S. Pat. No. 3,492,767

This patent discloses a prefabricated building construction including a prefabricated utility core which contains the entire power supply for a building.

Hitchins—U.S. Pat. No. 4,627,205

This patent discloses the associating of a conventional form for in-situ casting of concrete foundations with a pair of sacrificial adjuncts, including reinforcement pins, rods, and hook-bolts.

Hensel—U.S. Pat. No. 1,540,988

This 1923 patent discloses a portable shelter adapted to minimize the effectiveness of aerial bomb attacks. A netting or protective structure is stretched across and arranged to overlie the object to be protected, which netting is supported so as to yield at the moment of impact.

Lawson—U.S. Pat. No. 2,928,405

This patent discloses a lightweight, portable shelter which can be compactly folded up when not in use, and is erectable in various configurations to provide different types of canopies or shades.

Collier—U.S. Pat. No. 5,295,335

This patent discloses a prefabricated shelter which consists of an arched framework having open opposite ends, an anchoring structure for securing the footing of the framework to the ground, and a roof assembly mounted to the top of the arched framework.

Montoya—U.S. Pat. No. 5,414,966

This patent discloses a vehicle enclosure for storing and protecting a vehicle. The enclosure has a base plate and a shell-like cover disposed thereover which, in turn, is hinged to the base plate. A retractable dolly is coupled to the cover with the dolly positionable in a retracted mode for placing the vehicle enclosure in a stowed configuration and in an extended mode for placing the vehicle enclosure in a transportable configuration.

The citing of the-above patents is not intended as an admission that any such patent constitutes prior art against the claims of the present application. Applicant does not waive any right to take any action that would be appropriate to antedate or otherwise remove any listed document as a competent reference against the claims of the present application.

Many technical problems relating to surface-mounted portable structures are overcome or resolved by the invention disclosed herein. The innovative approach becomes apparent in the description which follows.

SUMMARY OF THE INVENTION

The present invention is directed to a portable garage with a ballast-containing base. The garage is readily assembled at a chosen site without physical attachment thereto and disassembled for erection at another site. Base segments or portions, which are elongated and extend along the sidewalls of the garage, are configured with a cavity therein. The cavity for receiving ballast is, after the erection of the portable garage filled with water, sand or gravel. The weight of the ballast stabilizes the structure. The elongated base portions have extensions or tabs which interlock with a connector base portion. An aperture through the connector houses a support or column member and, upon the sidewall being assembled and set up, the columns are substantially, vertically disposed. The interposing of the two base portions—one into the other—is such that the weight of the ballast-containing base and column-receiving base portions. Between the support members a roof is attached. The roof is either prefabricated attaching directly to the support members or is assembled from discrete components mounted on roof beams or trusses which, in turn, are mounted to the support members.

The ballast-container or base has a cavity for receiving ballast and is a lightweight, molded plastic construct of high-impact, UV resistant material. A typical base unit weighs 6 to 7 lbs per linear foot and, typically, upon loading with ballast, 80 to 120 lbs. per linear foot. The base is equipped with suitable inlet ports and outlet ports for the addition and removal of ballast, namely, water, sand or gravel. The column base portions which interlock with the ballast-container base are further provided with a well for accommodating a flanged collar. The flange of the flanged collar rests on the floor or surface upon which the portable structure is erected and extends beyond the aperture housing the column. The column, in turn, is adjustably connected to the collar enabling the tops of the support columns to lie in a horizontal plane.

After erecting the portable garage, the ballast containers are filled through the inlet port with a ballast material of choice. Upon disassembly for relocating the structure, the ballast material is removed through the drain port. For ease of handling, the ballast containers nest for compact storage and transport.

OBJECT AND FEATURES OF THE INVENTION

It is an object of the present invention to provide a garage which is a readily erected and readily disassembled structure.

It is a further object of the present invention to provide a sturdy, free-standing structure that is erectable by placement upon a concrete or blacktop surface.

It is yet another object of the present invention to provide a garage structure with ballast-containing walls.

It is still yet another object of the present invention to provide a garage structure which is erected and disassembled using simple tools, and, upon disassembly, can be readily relocated.

It is a feature of the present invention that the weight of the ballast is sufficient to maintain the garage structure securely mounted to the floor.

It is another feature of the present invention to have inlet and outlet ports permitting the addition of and drainage of ballast material.

It is yet another feature of the present invention to have the ballast-containing wall portions interlockingly engage the column bases so as to provide support and stabilization therefor.

Other objects and features of the invention will become apparent upon review of the drawings and the detailed description which follow.

BRIEF DESCRIPTION OF THE DRAWINGS

In the following drawings, the same parts in the various views are afforded the same reference designators.

DESCRIPTION OF THE PREFERRED EMBODIMENT

Figure 1:
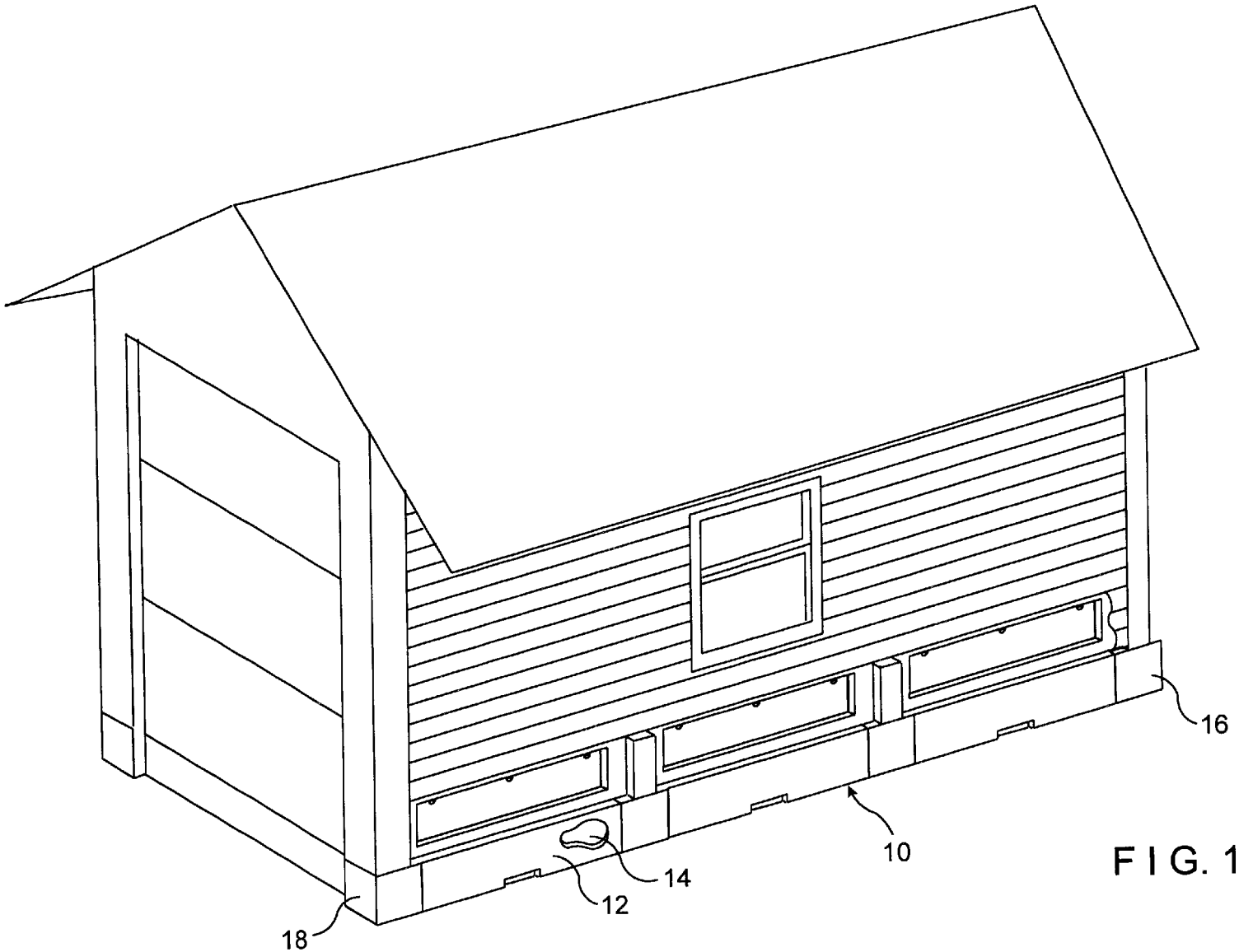
FIG. 1 is a perspective view of the garage with ballast-containing walls of the present invention.
Figure 3:
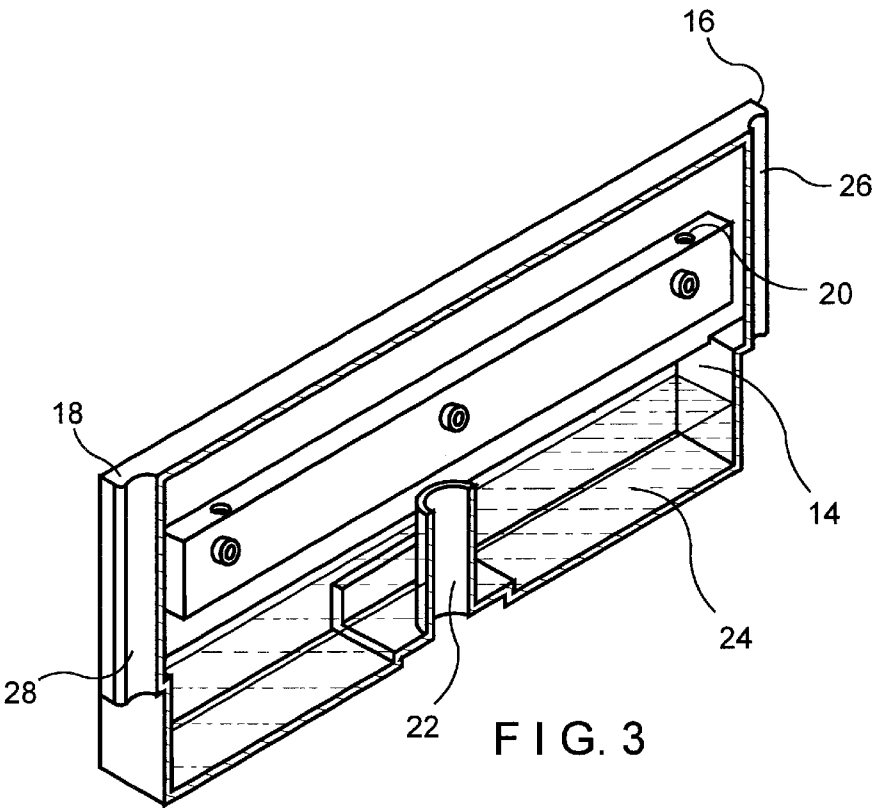
FIG. 3 is a cutaway view of the base portion of FIG. 2 taken along line 3—3 of FIG. 2 and showing the ballast chamber with the inlet and outlet ports therefor.
Figure 2:
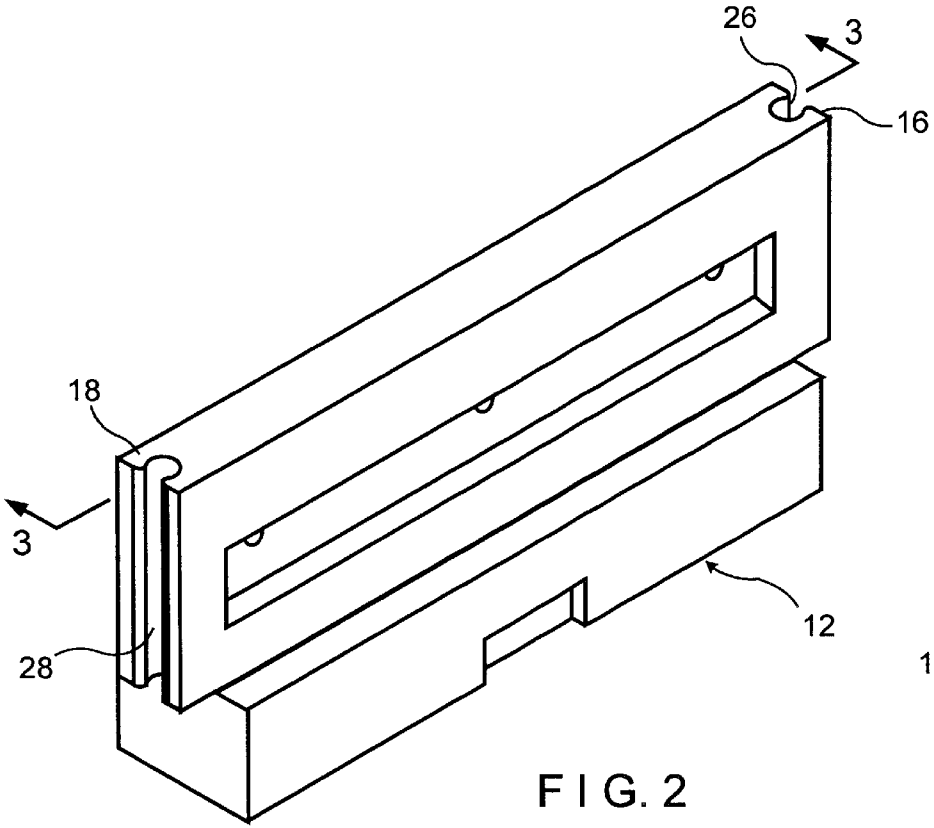
FIG. 2 is a perspective view of the base portion of FIG. 1 showing the connecting keyways which overlie the base connectors.

Referring now to FIGS. 1 through 3, the portable garage with ballast-containing walls is shown and is referred to generally by reference numeral 10. The elongated base portions 12 are formed from a thermoplastic material which has sufficient structural strength to retain ballast material within the cavity 14 therewithin. The base portion 12 extends at both ends having keyway portions 16 and 18. The keyway portions 16 and 18, when the elongated base portion 12 is filled with ballast, hold down underlying structural elements and stabilize the overall construct. The plastic base portion 12 is an adaptation of the Barrier System, manufactured for Barco Products Company, Batavia, Ill. 60510-1961. The elongated base portion has a fill port 20 and a drain port 22 for receiving ballast 24 into cavity 14 and for removing ballast therefrom. Materials suitable for ballast 24 include water, sand and gravel. Although the present structure is designed more for a fluid aqueous ballast than for a dry ballast, minor adjustments such as a replacement of the overflow pipe with a bunghole-type arrangement can be instituted to adapt the unit to the use of dry ballast. The keyway portions 16 and 18 also include interlocking keyways or joints 26 and 28, respectively, similar to mortise and tenon joinery, fitting with the adjacent base connector portion described, infra.

While the keyway portions here are shown as semicircular indentations in cross-section, any number of shapes may be employed so long as the male and female interlocking portions thereof fit readily one within the other and enable the various subcomponents jointed together to be in sliding and locking engagement with each other.

Figure 5:
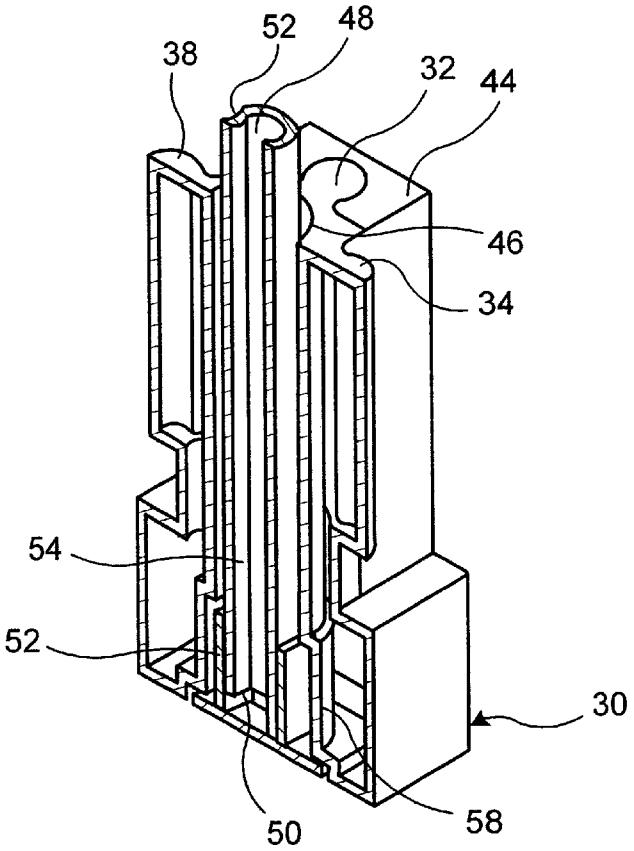
FIG. 5 is a cutaway view of the base connector and vertical support member taken along line 5—5 of FIG. 4.
Figure 4:
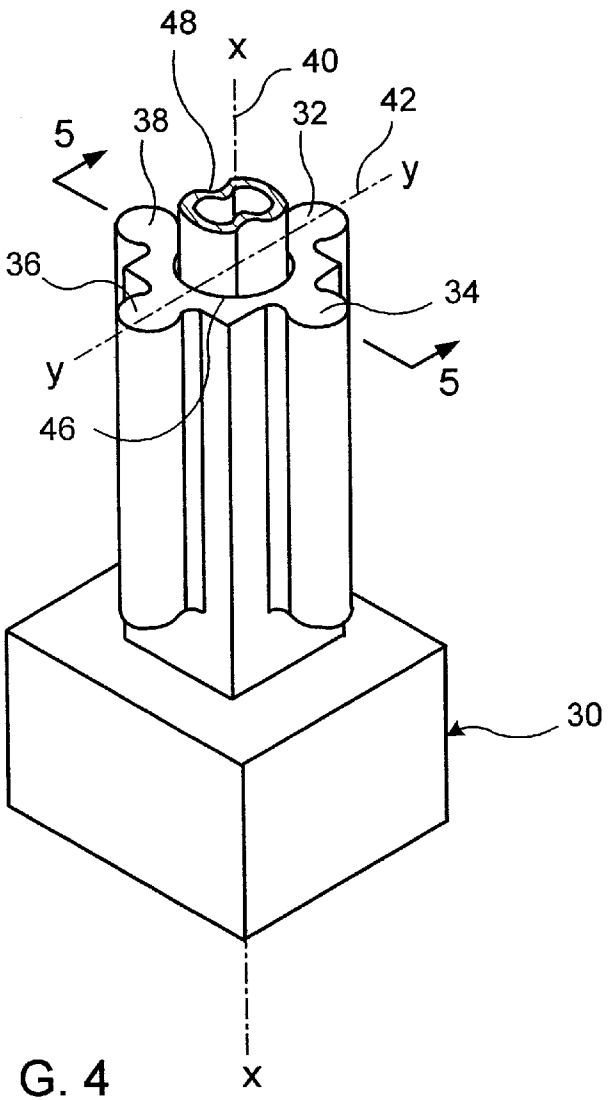
FIG. 4 is a perspective view of the base connector shown with the vertical support member therewithin.

Referring now to FIGS. 4 and 5 a universal base connector 30 is shown having four male segments 32, 34, 36 and 38. Relative to the x-axis 40, these are set at 0°, 90°, 180°, and 270°, respectively, using the y-axis 42 as the initial reference line therefor. While a single, universal base connector 30 is shown, it is within the contemplation of the invention to include a straight connector with male segments at 0° and 180°; T-connectors with male segments at 0°, 90° and 180° or at 0°, 180° and 270°; and L-connectors with male segments at 0° and 90° or at 0° and 270°. As the universal, 4-way connector may be adopted to simplify manufacturing, a cover or filler 44 is employed to sheathe, where desired, the unused male segments.

To interlock with joints or splines 26 and 28 corresponding fittings 34 are molded into the connector base portions. If the joints 26 and 28 are female, then the corresponding fitting 34 is male and vice versa. The connector base portions 30 each have a central bore 46 along longitudinal axis 40 therethrough and, when the portable garage is erected, the longitudinal axis 40 of the central bore 46 is substantially vertical. A column or support member 48 is constructed to be retained by the base connecter 30. In the example at hand, the central bore 46 is a 3 17/32" (approx.) through hole accommodating support members 48 of 2½" square, extruded aluminum material. The lower end 50 of support member 48 is held by a flanged collar 52. The support member 48 is adjustably attached to collar 52 by attaching hardware 54. The adjustability enables levelling of the upper ends 56 of support members 48. The flanged collar 52 is dimensioned to fit within a well 58 of base connector portion 30. This covering of the attachment creates, once the ballast 24 is added, a tamper-resistant structure.

Figure 6:
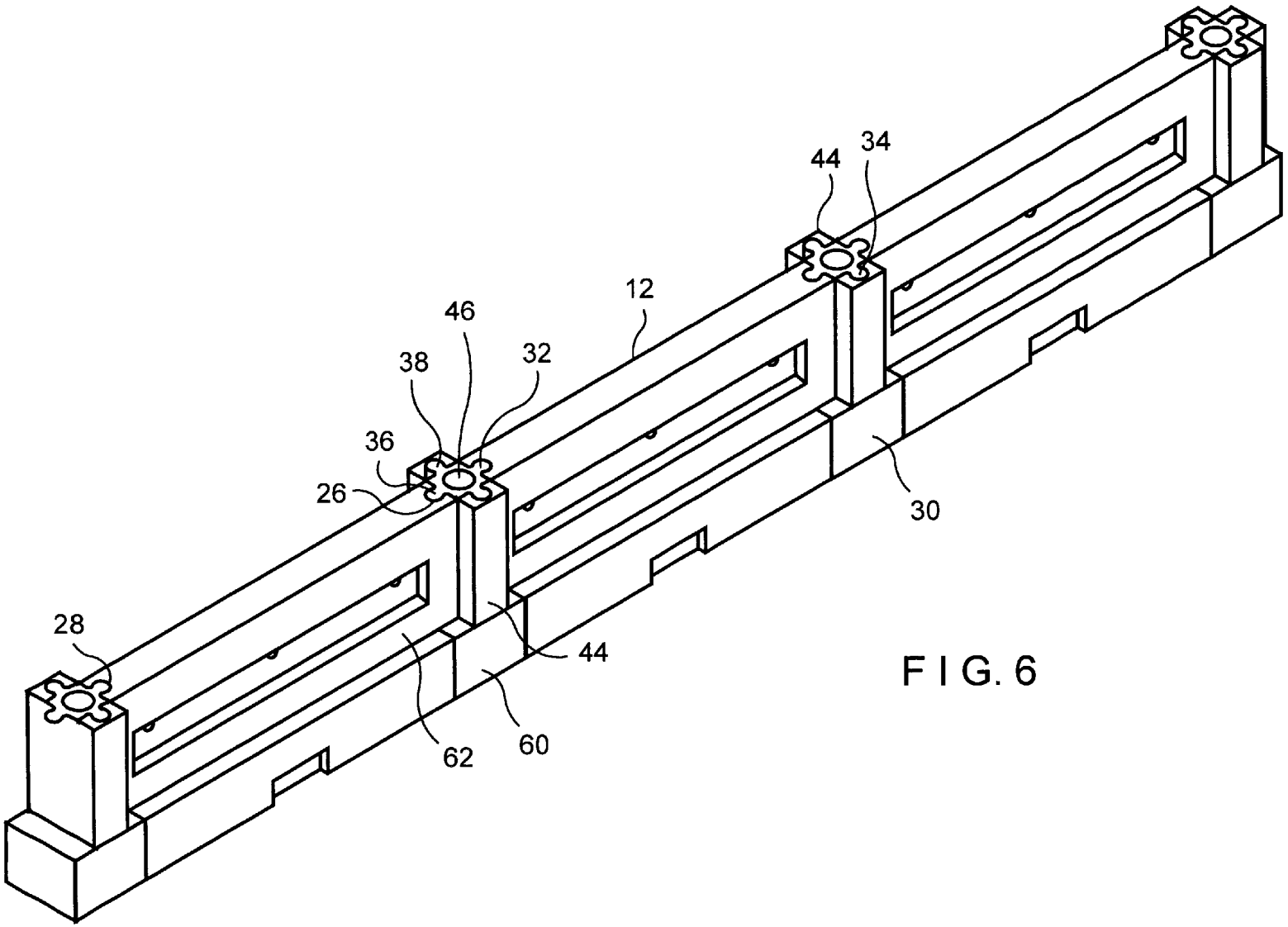
FIG. 6 is a perspective view of base portions as in FIG. 2 assembled to a se connectors as in FIG. 4.

Referring now to FIG. 6, the elongated base portion 12 is shown interlocked with the universal connector base 30 and covers 44 installed upon the unused male joints 34 and 38. The lower portion 60 of connector base 30 extends below the upper portion 62 of elongated base portion 12 and upon ballast being added to cavity 14, locks the structure together.

Figure 7:
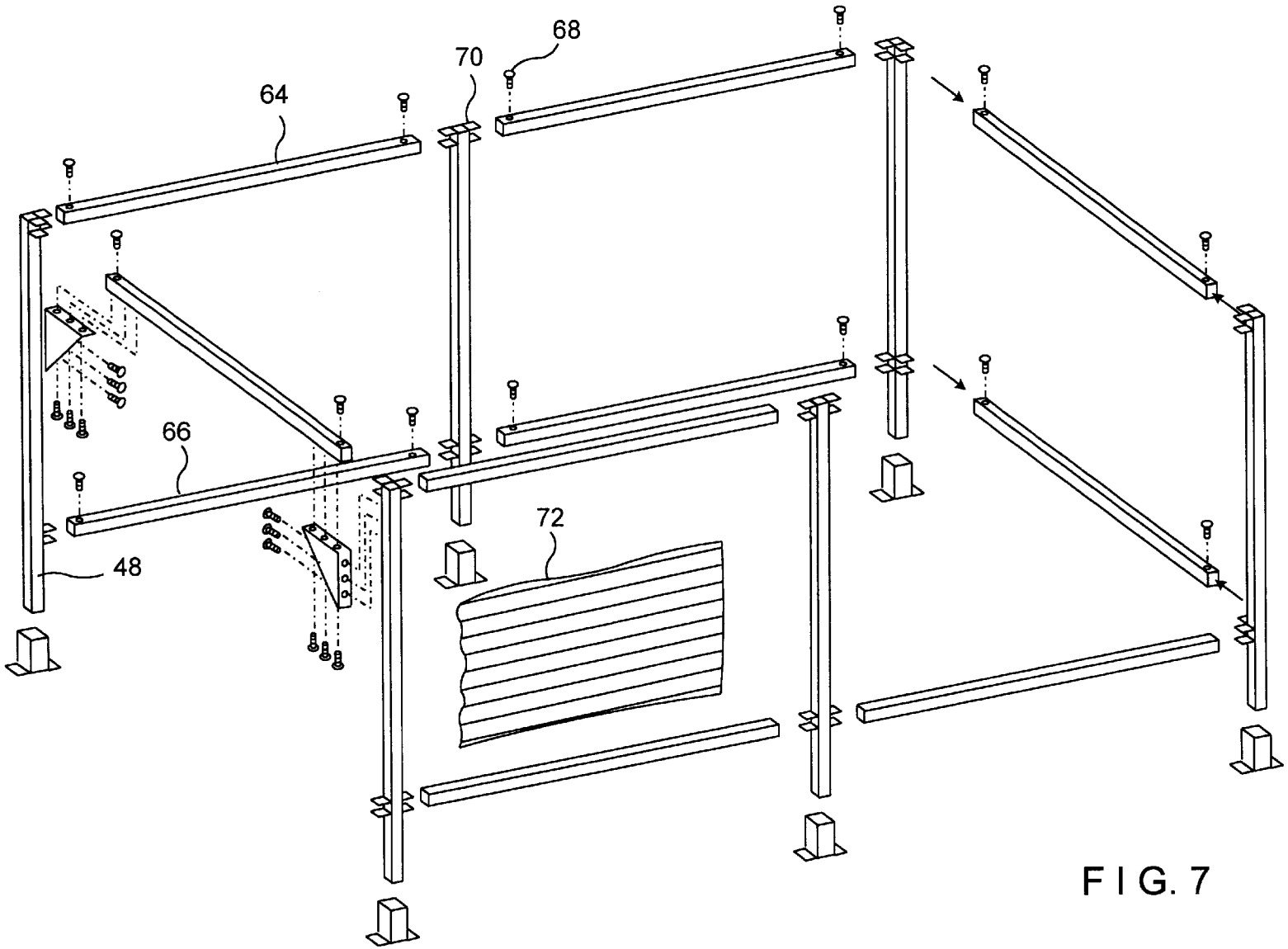
FIG. 7 is a partially exploded view showing the upper framework and the roof support of the invention; and, FIG. 8 is a schematic view of the upper wall and roof support structure of this inventor.

The framing for the walls is completed by horizontal beams wall caps 64 and intermediate stringers 66, FIG. 7, which beams are preferably of the same construction as the columns 48 and are attached thereto by attaching hardware 68 and 70, respectively. To complete the walls, glazing or prefabricated wall panels 72 are mountable and demountable to and from the framework formed by columns 48, wall caps, 64 and stringers 66.

Figure 8:
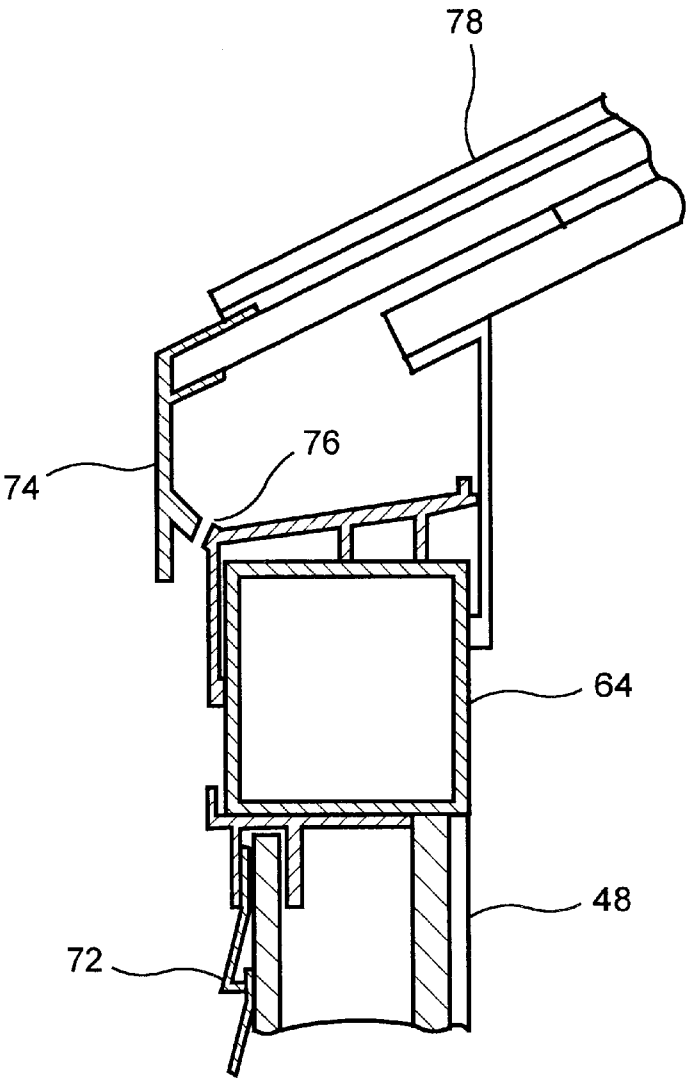

Atop the wall cap 64, a roof structure is formed using any one of numerous configurations,. Typifying such installations is the arrangements shown in FIG. 8. Here an extruded aluminum fascia 72 having an integral gutter 74 is emplaccable upon the wall cap 64. The gutter 74 incorporates weep holes 76 for drainage of water therefrom. As with the wall structure, the roof structure consists of prefabricated roofing panels 78 that are readily mountable and demountable to and from the upper framework. Depending upon the roof configuration selected additional roof supports may be added as required.

In the construction of the portable garage, the assembly and, conversely, the disassembly is accomplished with simple hand tools such as the screwdriver and a wrench. First a site is selected or formed having a relatively flat surface or with a slope maintaining, after adjustment of the support members, the horizontal disposition of the wall caps. The emplacements of the base portions and the universal base connectors are established and interconnected. The wall framing elements together with the roof fascia components are next laid out and connected on the ground. The lower ends of the columns are inserted through the base connectors and attached loosely to the flanged collars. The wall units are then righted to a vertical alignment and interconnected with the adjacent walls. The columns about the garage are next adjusted so that the desired alignment of the roof line is achieved. With the base and frame completed the prefabricated wall panels and roofing components are attached. The ballast cavities are next filled with water so as to provide the necessary weighting of the unit. The construction of thus completed without any foundation therebelow or attachment thereof to footings at the site.

The disassembly and erection of the portable garage at another site proceeds by essentially reversing the erection procedure described above. After emptying the ballast cavities, the garage components are moved to the new site, the erection procedures are followed, and the ballast is replenished.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A portable garage mountable on the surface of a site, said portable garage for protecting an automobile parked therein comprising:

a base having a lower face adapted for emplacement upon said surface, in turn, comprising:

a plurality of wall bases, each being an elongated body and having a lower base portion with a cavity adapted to receive ballast therewithin and an upper base portion extending longitudinally beyond said lower base portion thereof;

a plurality of base connectors, each mountable adjacent to and interlockable with at least one of said wall bases, extending below said upper base portion, each one of said base connectors, upon ballast being added to said interlockable one of said wall bases, disposed to being held down thereby;

a bore in each of said base connectors, each said bore upon erection of said portable garage, extending substantially vertically through the respective one of said base connectors;

a plurality of support members, each one disposed in a respective bore, said support members for supporting walls and a roof structure;

a roof extending between said support members adapted to protect said automobile parked thereunder; and whereby, upon filling one or more of said wall bases with ballast, the structure becomes stabilized without requiring an excavated foundation.

2. A portable garage as described in claim 1, further comprising:

a flanged collar housed in the lower end of said bore receptacle having a receptacle portion and a flange portion, said receptacle portion receiving said support member therewithin;

said flange portion of said flanged collar extending beyond said bore and below said respective one of said base connectors; and, attaching means connecting said flanged collar to said support members.

3. A portable garage as described in claim 2, further comprising:

a well in said lower surface of said base dimensioned to accept said flanged portion of said flanged collar;

one of said base connectors disposed about said flanged collar, said support member, and said attaching means;

whereby, upon filling one or more of said wall bases with ballast, the structure is tamper resistant.

4. A portable garage as described in claim 3 wherein each one of said base connectors further comprises:

an upper connector portion;

a plurality of splines for interconnecting building components to said upper base portion; and wherein said upper base portion of each of said wall bases further comprises:

a plurality of keyways for accepting said splines therewithin.

5. A portable garage as described in claim 4 wherein each of said base connectors has two splines mounted 180° apart to accept two wall bases of the same wall.

6. A portable garage as described in claim 4 wherein each of said base connectors has two splines mounted 90° apart, each for accepting one of said wall bases of adjacent walls.

7. A portable garage as described in claim 4 wherein each of said base connectors has three splines mounted 90° apart, each for accepting one of said wall bases in a T-arrangement.

8. A portable garage as described in claim 4 wherein each of said base connectors has four splines mounted 90° apart, for accepting up to four said wall bases.

9. A portable garage as described in claim 2 further comprising a roof support beam attached to at least two said support members.

10. A portable garage as described in claim 9 wherein said flange portion is adjustably attachable to said support member for leveling and canting said roof support beam.

* * * * *